US005951303A

United States Patent [19]

Wilmsmann née Sudmöller

[11] Patent Number: 5,951,303

[45] Date of Patent: Sep. 14, 1999

[54] CONTACT STRIP FOR PRINTED CIRCUIT BOARDS

[75] Inventor: Ute Wilmsmann née Sudmöller, Halver, Germany

[73] Assignee: Firma Karl Lumberg GmbH & Co., Schalksmuhle, Germany

[21] Appl. No.: 08/847,846

[22] Filed: Apr. 28, 1997

[30] Foreign Application Priority Data

Apr. 29, 1996 [DE] Germany ..... 196 17 121

[51] Int. Cl.[6] ..... H01R 9/09

[52] U.S. Cl. ..... 439/66; 439/80

[58] Field of Search ..... 439/66, 71, 72, 439/80

[56] References Cited

U.S. PATENT DOCUMENTS 5,125,846 6/1992 Sampson et al. ..... 439/66
5,199,884 4/1993 Kaufman et al. ..... 439/80
5,358,411 10/1994 Mroczkowski et al. ..... 439/66
5,484,295 1/1996 Mowry et al. ..... 439/66
5,574,383 11/1996 Saito et al. ..... 439/71

FOREIGN PATENT DOCUMENTS 2 251 138 6/1992 United Kingdom .

*Primary Examiner*—Paula Bradley
*Assistant Examiner*—Katrina Davis
*Attorney, Agent, or Firm*—Herbert Dubno

[57] ABSTRACT

A contact strip for printed circuit boards, especially in a sandwich construction has E shaped contact members with contact shanks of successive contact members along the strip extending in opposite directions and a central strap anchored in the insulating body of the contact strip. The contact members are held in place by a central long codirectional with the contact shanks but laterally offset therefrom by a distance x which also corresponds to the spacing between successive contact shanks.

14 Claims, 2 Drawing Sheets

CONTACT STRIP FOR PRINTED CIRCUIT BOARDS

FIELD OF THE INVENTION

My present invention relates to a contact strip for printed circuit boards and, more particularly, to a contact strip adapted to be sandwiched between two printed circuit boards and which comprises an insulating body having a multiplicity of generally E-shaped contact members spaced along it with a certain pitch x and having a pair of coplanar contact shanks overlying opposite sides of the insulating body and a tongue between the shanks. The contact shanks can engage contacts on the printed circuit boards.

BACKGROUND OF THE INVENTION

A contact strip of the aforedescribed type which can be disposed between printed circuit boards in a sandwich assembly in which the contact strip is contacted on its opposite sides by respective printed circuit boards, is known, for example from U.S. Pat. No. 5,484,295 which discloses contact elements which are spaced apart by a contact pitch, each of these contact elements having a portion fixed in the insulating body. The contact elements can have contact shanks which can engage the conductive tracks of the printed circuit boards. The contact shanks of each element form a U-shaped stirrup in side view while a central member is embedded in the insulating body during the injection molding process. The insulating body can be mounted in a frame-like housing. The mounting of the contact elements is complex in the fabrication of such contact strips, especially when the contact density is high, i.e. the inter-contact pitch is small, and the system is miniaturized for use in miniature circuits.

In U.S. Pat. No. 5,358,411, by contrast, the contact strip is provided with E-shaped contact elements whose outer shanks are formed by contact shanks and whose central shank can be inserted in a slit of the insulting body for retaining the contact members thereon. Such three-shank contact members can be stamped from flat sheet metal of a contact alloy and in the flat form can be inserted in the insulating body. The shanks can then be bent around the body during the mounting of the contact strip between the printed circuit boards. This ensures high contact pressures even in the case where the contact edges themselves are relatively small. The contact elements themselves can be relatively resistant to bending, i.e. particularly stiff. With a high level of miniaturization, the shank lengths can be small and the spring displacement of the shanks can likewise be minimal, but the contact shanks themselves must be capable of generating high contact pressures. In practice, the contacts must be guided to ensure high quality electrical interconnection with reduced contact forces.

OBJECTS OF THE INVENTION

It is the principal object of the present invention to provide an improved contact strip which is capable of providing high contact pressures and to overcome drawbacks of earlier systems.

Another object of the invention is to provide an improved contact strip which is capable of miniaturization so as to have a relatively high contact density and contacts of small size, but nevertheless sufficient contact pressure and relative ease in assembly and fabrication.

SUMMARY OF THE INVENTION

These objects and others which will become apparent hereinafter are attained, in accordance with the invention in a contract strip of the type described wherein the central tongue serves as a mounting tongue and is fitted into a slit of the insulating body, the contact shanks overlie opposite sides of the insulating body and the central tongue is laterally offset from a common plane of the outer contacting elements by the pitch distance x. More particularly, the contact strip of the invention can comprise:

an elongated electrically insulating body; and a multiplicity of contact members spaced apart along the body, each of the contact members being of generally E-shape and being provided with a pair of mutually coplanar contact shanks overlying opposite outer surfaces of the body so that successive contact shanks of the members along each of the sides are spaced apart with a contact pitch x, and a tongue extending generally codirectionally with the respective shanks, received in a slit formed in the body, and laterally offset from a common plane of the contact shanks by a distance of the pitch x.

A sandwich assembly according to the invention can comprise:

a pair of spaced apart printed circuit boards; and a contact strip sandwiched between the printed circuit board, the contact strip comprising:

an elongated electrically insulating body, and a multiplicity of contact members spaced apart along the body, each of the contact members being of generally E-shape and being provided with a pair of mutually coplanar contact shanks overlying opposite outer surfaces of the body so that successive contact shanks of the members along each of the sides are spaced apart with a contact pitch x, and a tongue extending generally codirectionally with the respective shanks, received in a slit formed in the body, and laterally offset from a common plane of the contact shanks by a distance of the pitch x.

The offset arrangement of the mounting tongue allows the tongue and the contact shanks to be bent into the E-shape simply and without complications from the flat sheet metal. The contact shanks can form leaf springs whose resilience does not depend upon providing the sheet metal on edge but which nevertheless can be closely spaced apart on the insulating body for miniaturization, enabling less contact pressure to be used since the contact shanks can engage the conductors of the printed circuit boards over broader areas, thereby increasing the reliability of the contact. The contact members may alternately straddle the elongated insulating member from opposite sides to thereby provide an intercontact pitch of 0.5 mm, for example. The contact shanks can lie in respective seats of the insulating body with each contact member secured by its tongue in a slit thereof.

With the offset and spacing of the contact members as described, each anchoring tongue of one contact member can lie in the plane of the contact shanks of a successive contact member. The contact strip of the invention thus provides a high number of poles which can be closely spaced.

In mass production of the contact strip, the insulating body can be provided with the contact members from opposite sides so that these members in effect extend around the insulating body, the contact shanks lying in seats or chambers insulated from one another and between contact members which extend from the opposite side. The contact strip can be so formed that at least one of the two contact shanks of each member is provided as an SMT solder leg or solder lug, the entire strip of contacts being soldered to the conductor strips of one or both of the printed circuit boards. Preferably however one of the two printed circuit boards presses on the spring contact sides on the opposite side of the contact strip. The contact strip also may be received between the printed circuit boards, only being held there by pressure of the boards. In the latter case it has been found to be advantageous to provide means flanking the contact strip to orient the latter and to space the printed circuit strip can be a pair of bars or a frame, prevent shifting of the contact strip should the force of which the contact strip is retained, because of e.g. chattering or vibration or the like.

The use of this means as a spacer, usually in conjunction with screws, bolts or rivets, drawing the two printed circuit boards toward one another, ensures that an exact distance will be maintained between the conductors of the printed circuit board. The tongues, according to the invention, can be self-anchoring in the slits, i.e. can hook or otherwise retain the contact member on the insulating body. Other formations which can be used can include a barb, claw or detent formation on the tongues.

The insulating body is preferably a one-piece injection molded part.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
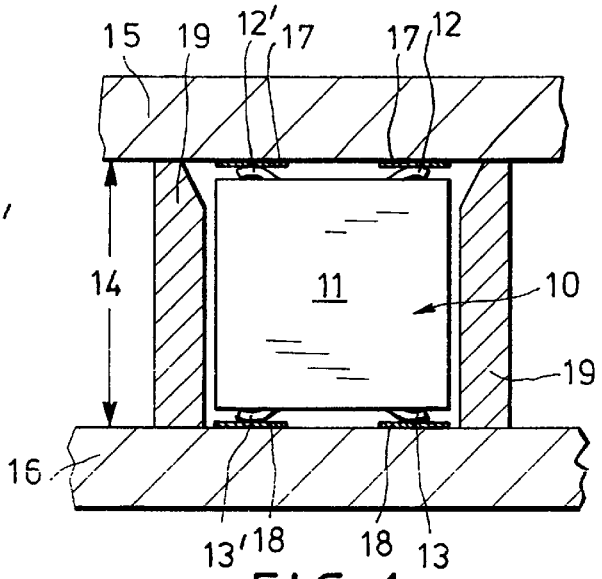
FIG. 1 is a transverse cross section through an assembly according to the invention showing the contact strip in an end view.
Figure 5:
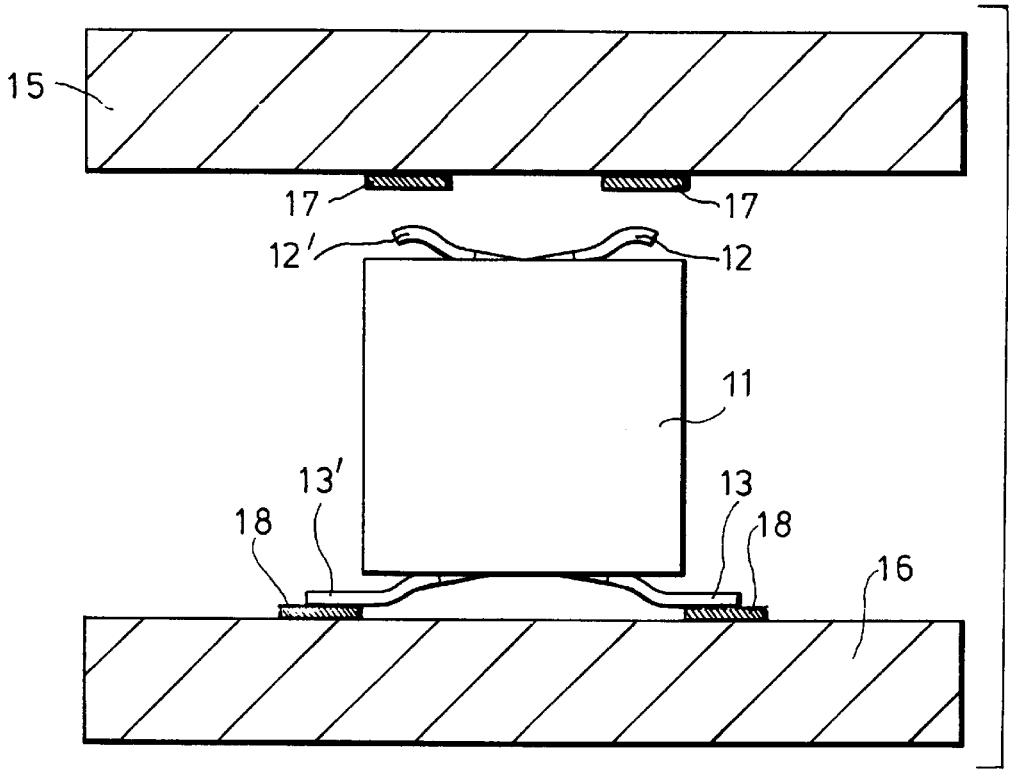
FIG. 5 is a view showing the positioning of the contact strip between two printed circuit boards with the contact shanks being formed as solder lugs or solder pads on one side.

In the drawing, the contact strip itself has been represented at 10 and, as can be seen from FIGS. 1 and 5, comprises an insulating body 11 which has been seen only in profile in these figures with the contacts shanks 12 and 13, 12' and 13' extending beyond the outline. The contact shanks are resilient upwardly and downwardly so that, when the contact strip is received between a pair of printed circuit boards 15 and 16 and the spacing 14 between these boards is less than the relaxed spacing between the contacts on opposite sides of the contact strip, the contact shanks 12, 13 and 12', 13' press against the conductor tracks 17 and 18 on the printed circuit boards.

Figure 4:
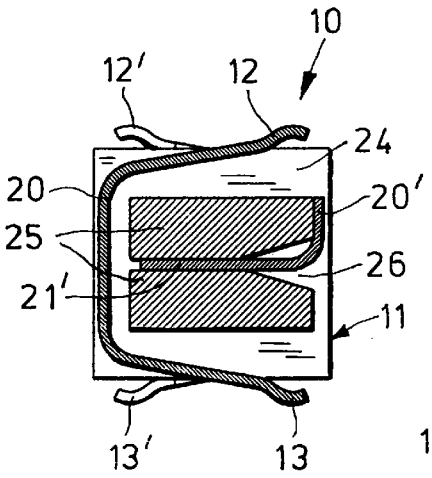
FIG. 4. is a cross section through the contact strip of FIG. 3 taken along the line IV—IV of FIG. 3.
Figure 3:
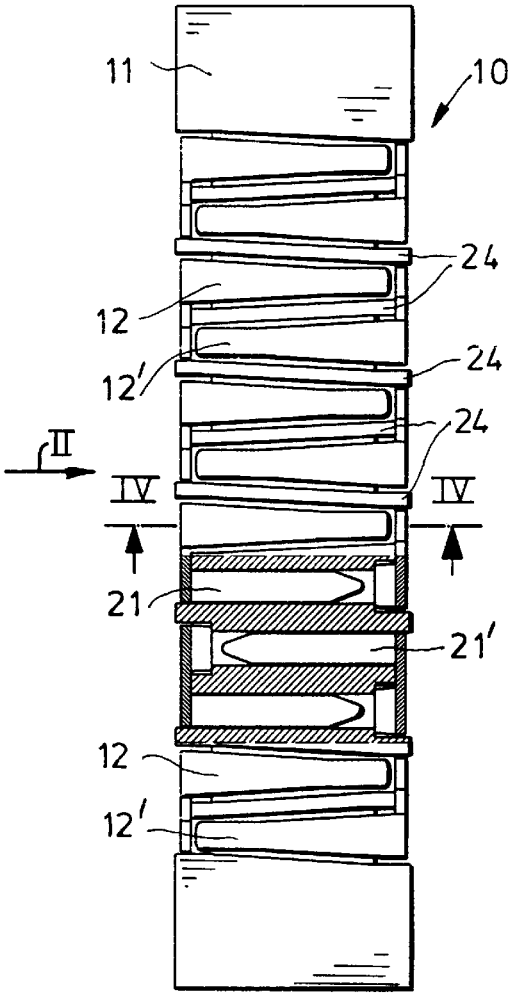
FIG. 3 is a bottom view partially broken away of the contact strip.
Figure 2:
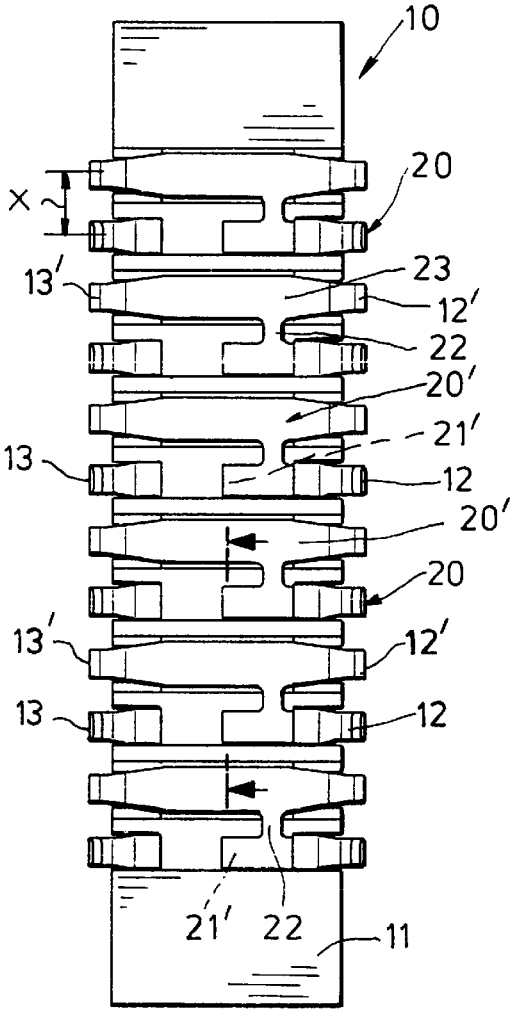
FIG. 2. is a side elevational view of the contact strip of FIG. 1.

The two printed circuit boards, which in practice can have a spacing of only about 3 mm or less from one another, are maintained parallel to one another by spacers in a conventional sandwich construction. In FIG. 1, spacers are represented by the bars 19 which flank the contact strip 10 and assist in maintaining the orientation thereof when the contact elements 12, 3, 12', 13' merely bear on the respective conductor tracks. As can be seen from FIG. 4, the contact shanks 12 and 13 are part of one contact member 20 which is received in a trough 24 formed in the body 11 with the shanks 12 and 13 extending in one section, namely, to the right. The contact members 20 have been shown in greater detail in FIGS. 6–8 and comprise a bight 23 connecting the codirectionally extending shanks 12, 13 and from which a lateral transition piece 22 extends to a tongue 21 which also projects codirectionally with the shanks 12 and 13, i.e. from left to right. The tongue 21 is therefore offset from the coplanar shanks 12, 13 by a distance x and the contact member 20 will have the configuration generally of the letter E. The contact shanks, tongue, bight and transition piece 22 are stamped in one piece from a sheet metal of a contact alloy, especially beryllium bronze and are bent out of the plane of the stamped sheet. The contact members 20 which extend in one direction alternate with identical contact members 20' (FIGS. 2–4) which extend in the opposite direction and alternate with the contact members 20. As noted from FIG. 2, between two contact members 20 and 21' which are considered to be neighbors along the strip, there is a contact pitch x. The contact pitch is the center to center distance between the contact shanks 12' and 12 of neighboring contact members 20' and 20.

Figure 6:
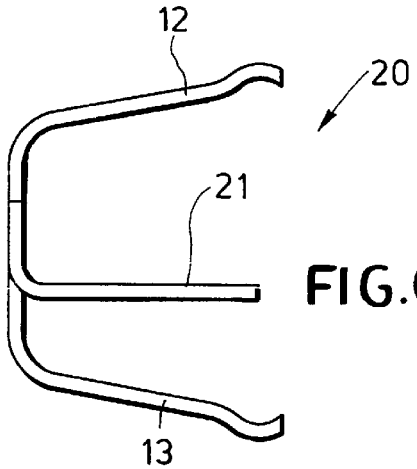
FIG. 6 is a side elevational view of one of the E-shaped contact members.
Figure 7:
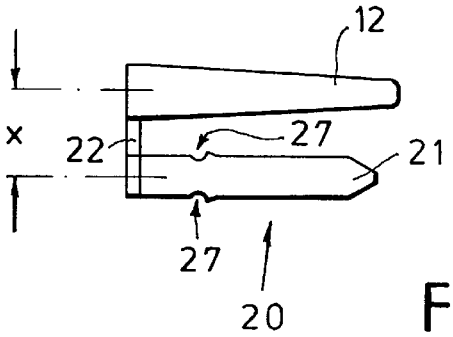
FIG. 7 is a top view thereof.
Figure 8:
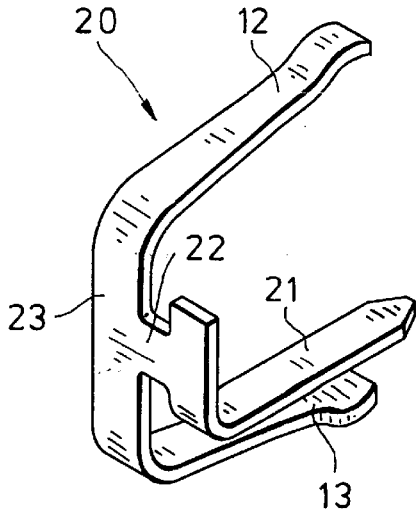
FIG. 8 is a perspective view thereof.

As can be seen from FIGS. 6 through 8, the tongue 21, which serves to affix the contact member 20 in the insulating body 11 has a spacing of its median plane from the common median plane of the shanks 12 and 13 of the same contact member by the same distance x which is the pole spacing of the contact strip.

The insulating body 11 is an injection molded part of a highly stable and shape retentive material which has practically no shrinkage. The insulating body 11 has a number of thin ribs which separate the troughs from one another, the troughs 24 defining a core 25 subdivided into two segments by a slit 26 in which the tongues 21 of the contact members 20 and 20' can be inserted from the respective side. The tongues 21 are anchored fixedly in these slits.

As has been indicated earlier, the tongues 21 are laterally offset from the contact shanks 12 13 so that each tongue 21 lies in the plane of the contact elements 12' and 13' of the neighboring contact member 20' so that the contact members from opposite sides along the strip effectively interdigitate with one another and form a high packing density, i.e. number of contact poles per unit length.

The contact strip 10 of FIG. 5 differs from that of FIG. 1 in that the lower contact shanks 13 and 13' are formed as SMT solder lugs and are soldered to the conductor tracks 18 of the lower printed circuit board 16. The upper printed circuit board 15 has not yet been brought into engagement with the lower printed circuit board in the view shown in FIG. 5 but, when it is lowered into place, will press the contact shanks 12 downwardly while the body 11 will be deflected downwardly to stress the contact shanks 13 and 13' so that the resiliency of the contact elements will provide the intrinsic pressure with which the contact shanks 12 and 21 engage the conductive tracks 17.

The anchoring tongues 21 are self-locking in the slits 26 and for this purpose barbs 27 can be formed in the edges of the tongue 21 (FIG. 7) for engagement in the body 11.

The E configuration of each individual contact element or member 20 is important to the invention since it allows the lateral offset of the tongues and the mounting of the contact member alternatively from opposite sides.

An important advantage of the system of the invention is that the contact shanks 12 and 13 can project to whatever degree may be desired beyond or from the body 11 since only the tongue 21 of each contact member need be secured thereto. The contact strip 10 can be fabricated with extremely small dimensions, for example, for a spacing 14 of the printed circuit boards of less than 3 mm and a pole spacing x of about 0.5 mm.

I claim:

1. A contact strip adapted to be sandwiched between two printed circuit boards, comprising:

an elongated electrically insulating body; and a respective multiplicity of contact members spaced apart along each of two opposite sides of said body, each of said contact members being of generally E-shape and being provided with a pair of mutually coplanar contact shanks overlying opposite outer surfaces of said body so that successive contact shanks of said members along each of said sides are spaced apart with a contact pitch x, and a tongue extending generally codirectionally with the respective shanks, received in a slit formed in said body, and lying in a tongue plane parallel to and laterally offset from a common plane of said contact shanks by a distance of said pitch x.

2. The contact strip defined in claim 1 wherein successive contact members are oriented oppositely on said body and alternating with one another.

3. The contact strip defined in claim 1 wherein at least one of the contact shanks of each of said members is formed as a solder lug.

4. The contact strip defined in claim 1 wherein said body is a one-piece injection molded body.

5. The contact strip defined in claim 1 wherein each of said contact members is stamped in one piece from sheet metal and said contact shanks and said attachment tongue of each member are bent into said E-shape.

6. A contact assembly comprising:

a pair of spaced apart printed circuit boards; and a contact strip sandwiched between said printed circuit board, and said contact strip comprising:

an elongated electrically insulating body, and a respective multiplicity of contact members spaced apart along each of two opposite sides of said body, each of said contact members being of generally E-shape and being provided with a pair of mutually coplanar contact shanks overlying opposite outer surfaces of said body so that successive contact shanks of said members along each of said sides are spaced apart with a contact pitch x, and a tongue extending generally codirectionally with the respective shanks, received in a slit formed in said body, and lying in a tongue plane parallel to and laterally offset from a common plane of said contact shanks by a distance of said pitch x.

7. The assembly defined in claim 6 wherein said contact strip is held exclusively by pressure contact with said boards between said boards.

8. The assembly defined in claim 7 further comprising means flanking said contact strip for maintaining orientation of said contact strip between said bores.

9. The assembly defined in claim 8 wherein said means includes a spacer for holding said printed circuit boards apart.

10. The assembly defined in claim 6 wherein successive contact members are oriented oppositely on said body and alternating with one another.

11. The assembly defined in claim 6 wherein at least one of the contact shanks of each of said members is formed as a solder lug.

12. The assembly defined in claim 6 wherein said body is a one-piece injection molded body.

13. The assembly defined in claim 6 wherein each of said contact members is stamped in one piece from sheet metal and said shanks and said attachment tongue of each member are bent into said E-shape.

14. The assembly defined in claim 6 wherein each of said contact members is self-anchored in said body by the respective tongue.

* * * * *